US006211825B1

(12) United States Patent
Deng

(10) Patent No.: US 6,211,825 B1
(45) Date of Patent: Apr. 3, 2001

(54) DUAL-NOTCH LOADED MICROSTRIP ANTENNA

(75) Inventor: Sheng-Ming Deng, Taipei (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/448,019

(22) Filed: Nov. 23, 1999

(30) Foreign Application Priority Data

Sep. 3, 1999 (TW) ..... 088115160

(51) Int. Cl.[7] ..... H01Q 1/38

(52) U.S. Cl. ..... 343/700 MS; 343/749; 343/830

(58) Field of Search ..... 343/700 MS, 749, 343/767, 770, 829, 830, 846, 848, 849; H01Q 1/38, 13/10

(56) References Cited

U.S. PATENT DOCUMENTS 5,216,430 * 6/1993 Rahm et al. ..... 343/700 MS
5,410,323 * 4/1995 Kuroda ..... 343/700 MS
5,646,634 * 7/1997 Bokhari et al. ..... 343/700 MS

* cited by examiner

*Primary Examiner*—Tho Phan
(74) *Attorney, Agent, or Firm*—Jiawei Huang; J C Patents

(57) ABSTRACT

A dual-notch loaded microstrip antenna has a single-medium substrate, a metal layer and a microstrip antenna layer, wherein the microstrip antenna layer of the microstrip antenna is etched into a double dual-notch or a single dual-notch structure. The microstrip antenna layer and the metal layer adhere respectively to opposite sides of the single-layer substrate, wherein the metal layer works as the electrical ground. The single-layer substrate contains a penetrating opening whose diameter and location are predetermined. The task of transmitting and receiving dual-band or multi-band signals is carried out by feeding the microstrip layer with signals from a connector, such as a coaxial connector, through the penetrating opening.

12 Claims, 9 Drawing Sheets

DUAL-NOTCH LOADED MICROSTRIP ANTENNA

CROSS-REFERENCE TO RELATED APPLICATION

This application claims the priority benefit of Taiwan application serial no. 88115160, filed Sep. 3, 1999, the full disclosure of which is incorporated herein by reference.

BACKGROUND OF THE INVENTION

1. Field of the Invention

This invention relates to a microstrip antenna, and more particularly, to a dual-notch loaded microstrip antenna for dual-band or multi-band applications, wherein the dual-notch loaded microstrip antenna of the invention.

2. Description of Related Art

The dual-band signal-layer microstrip antenna has been widely used in applications like radar and communication systems, because of its advantages over a conventional antenna, such as lighter weight, lower profile and lower cost.

Generally, dual-band single-layer microstrip antennas can be categorized into categories include stub-type microstrip antenna, notch-type microstrip antenna, pin-and-capacitor-type microstrip antenna, and slot-loaded-type microstrip antenna.

As referring to FIG. 1, the top view of a conventional slot-type microstrip antenna disclosed in the U.S. Pat. No. 4,692,769, "Dual-band Slotted Microstrip Antenna", is shown. The slot-type microstrip antenna in FIG. 1 contains a slot 44, which stimulates the signals of some lower orthogonal modes and then emits the signals to achieve the dual-band function. Due to the slot and feeding structure shown in FIG. 1, two orthogonal lower-mode emissions are created, and the polarization direction of the antenna is 90 degrees.

Referring to FIGS. 2A and 2B, the top view and cross-sectional view of a conventional multi-band microstrip antenna are illustrated respectively, wherein the multi-band microstrip antenna has been disclosed in U.S. Pat. No. 5,329,378, "Multi-band Microstrip Antenna". For such a microstrip antenna, the achievement of emitting multi-band signals is carried out by partially hollowing out cavities in the single-layer substrate, or assembling cut media of different properties into a single layer substrate. However, not only the complicated fabrication process itself increases the fabrication cost, any minor misplacement of parts in assembly process or misalignment occurring in cutting process would seriously degrade the performance of the antenna.

Referring to FIGS. 3A and 3B, the top view and cross-sectional view of a multilayer dual-band microstrip antenna are illustrated respectively, wherein the multilayer dual-band microstrip antenna has been disclosed in U.S. Pat. No. 5,561,435 "Planar Lower Cost Multilayer Dual-band Microstrip Antenna". The dual-band microstrip antenna shown in FIGS. 3A and 3B consists of two stacked substrates, each of them contains a metal layer of various dimension. The dimensions of metal layers over substrates are defined correspondingly to the designated resonant frequencies. However, since the fabrication process of the foregoing dual-band microstrip antenna involves stacking two substrates, therefore, the fabrication cost is increased. In addition, shifting and defective coupling occurring in the stacking process also badly affect the performance and stability of the antenna.

In accordance with the foregoing, a microstrip antenna fabricated through a low-cost, efficient, and high-tolerance fabrication process is needed.

SUMMARY OF THE INVENTION

Therefore, the invention provides a dual-notch loaded microstrip antenna including a single-layer and single-medium substrate, a metal layer, and a microstrip layer, wherein the microstrip layer of the microstrip antenna of the invention is etched into a double dual-notch or signal dual-notch structure. The microstrip layer and the metal layer adhere respectively to opposite sides of the single-layer substrate, wherein the metal layer works as the electrical ground. The single-layer substrate contains a penetrating opening whose diameter and location are predetermined. The task of transmitting and receiving dual-band or multi-band signals is carried out by feeding the microstrip layer with signals through the penetrating opening.

In accordance with the foregoing, the dual-notched loaded microstrip antenna of the invention contains only one single-layer, single-medium substrate and a penetrating opening located thereon. Therefore, defects caused by misplacement, misalignment and shifting can be effectively avoided to improve the performance and stability of the antenna. Additionally, the simplified fabrication process can also lower the fabrication cost.

BRIEF DESCRIPTION OF DRAWINGS

The invention can be more fully understood by reading the following detailed description of the preferred embodiments, with reference made to the accompanying drawings, wherein.

DETAILED DESCRIPTION OF PREFERRED EMBODIMENTS

The invention provides a new dual-notch loaded microstrip antenna and its derivations. The top view and cross-sectional view of a double dual-notch loaded microstrip antenna of a preferred embodiment according to the invention are illustrated in FIGS. 4A and 4B.

Figure 1:
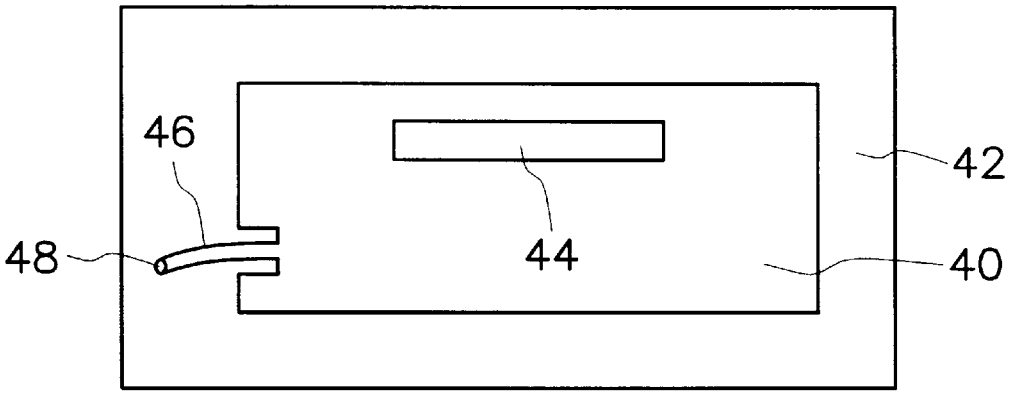
FIG. 1 (PRIOR ART)
FIG. 1 is a schematic diagram showing the top view of a conventional dual-band slotted microstrip antenna.
Figure 2A:
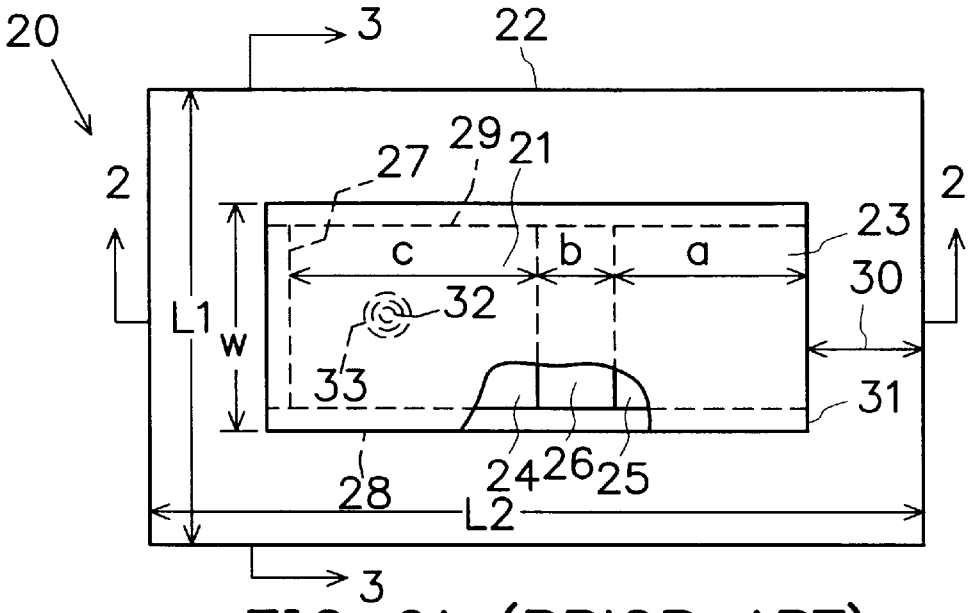
FIG. 2A (PRIOR ART)
FIGS. 2A and 2B are schematic diagrams showing the top view and cross-sectional view of a conventional multi-band microstrip antenna respectively.
Figure 2B:
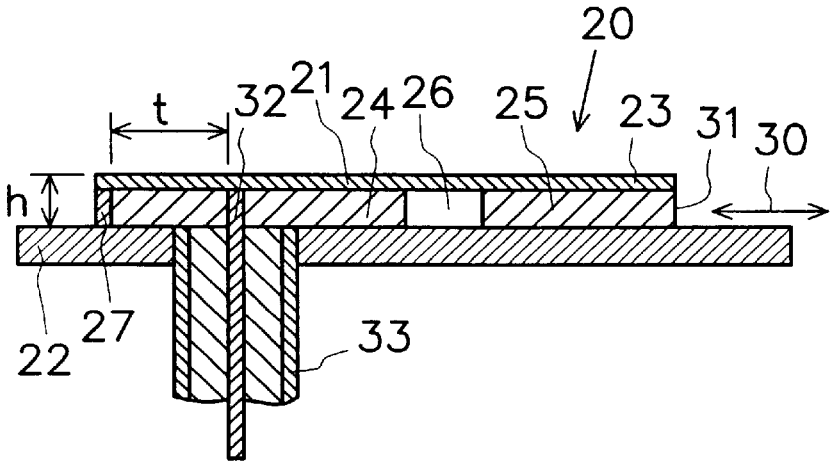
FIG. 2B (PRIOR ART)
Figure 3A:
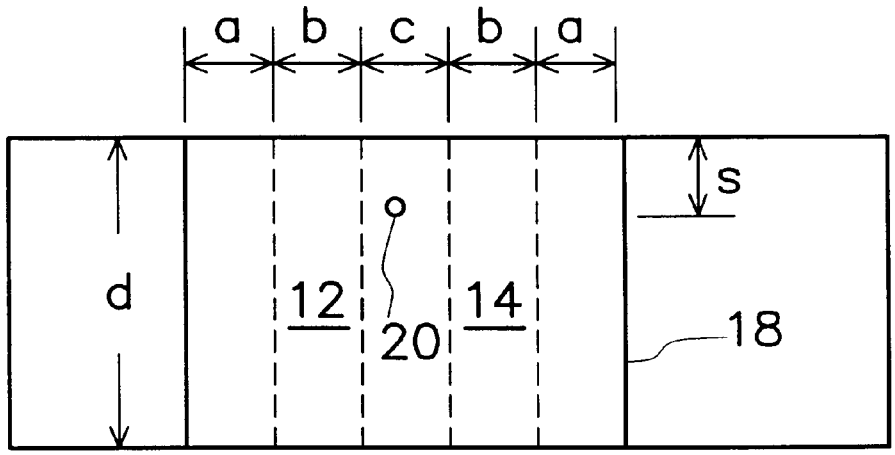
FIG. 3A (PRIOR ART)
FIGS. 3A and 3B are schematic diagrams showing the top view and cross-sectional view of multilayer dual-band slotted microstrip antenna respectively.
Figure 3B:
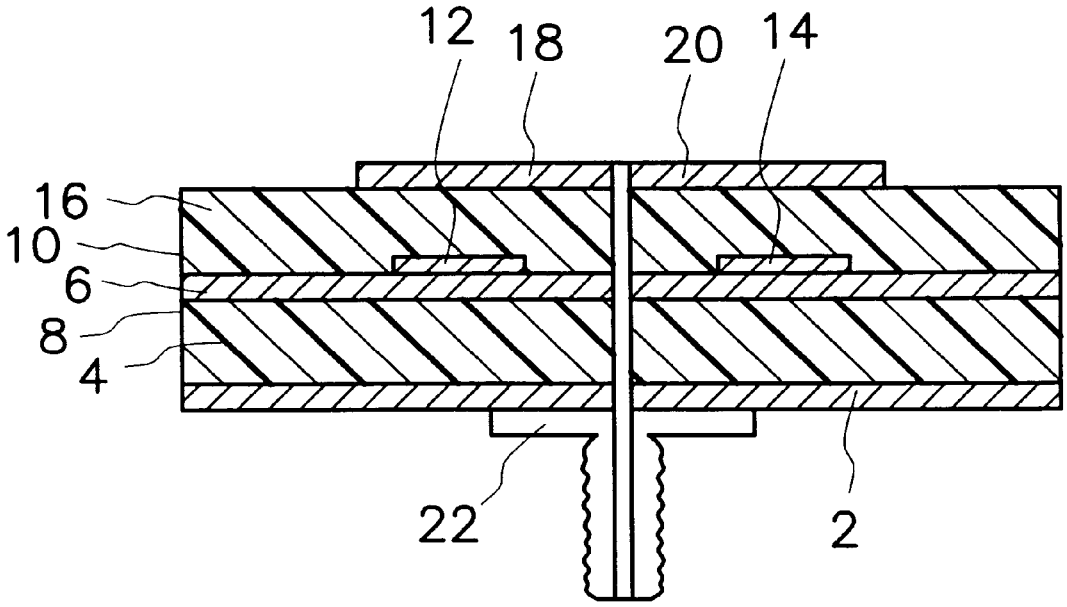
FIG. 3B (PRIOR ART)
Figure 4A:
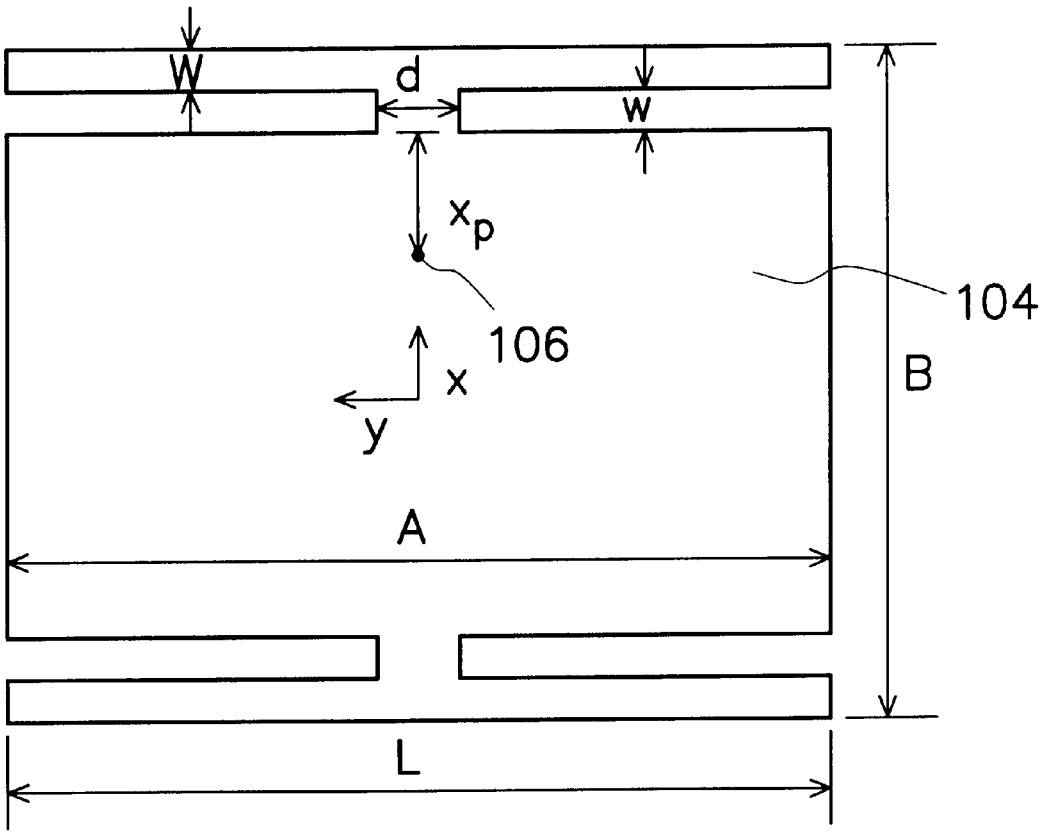
FIGS. 4A and 4B are schematic diagrams showing the top view and cross-sectional view of a double dual-notch loaded microstrip antenna of a preferred embodiment according to the invention.
Figure 4B:
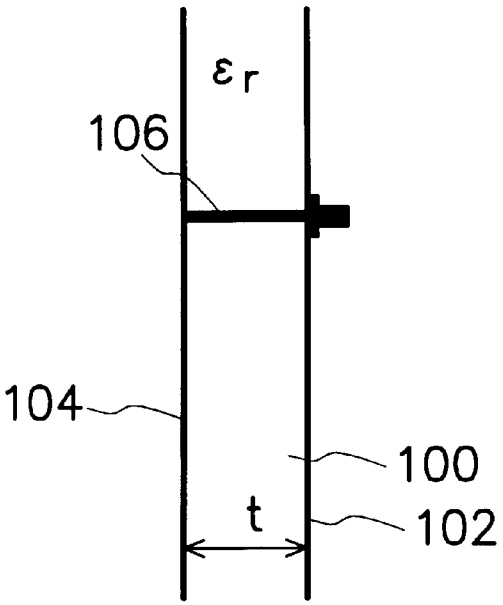

Referring to FIG. 4B, the entity of the dual-notch loaded microstrip antenna of the invention basically includes a single-layer substrate 100, a microstrip layer 104 attached to one side of the single-layer substrate 100, and a metal layer 102 attached to the other side of the single-layer substrate 100. The metal layer 102 is electrically connected to the ground to serve as an electrical ground. A penetrating opening 106 is formed on the substrate 100. Through a proper connector, such as a coaxial connector, signals can be fed to the microstrip layer 104 from the metal layer 102. Besides the method of coaxial feed described above, other methods may also be used to transmit signals.

The microstrip layer 104 of the invention is etched into mostly symmetric shapes that normally individually contain a dual-notch to serve as a dual-notch loaded microstrip antenna, according to a preferred embodiment of the invention, as shown in FIG. 4A for top view and FIG. 4B for side cross-sectional view. Due to the notches, the dual-notch microstrip antenna 104 therefore can create dual bands of frequency band or multiple bands of frequency.

Theoretically, the characteristics of a micro-strip antenna are determined by its cavity model described the distribution of electrical current on the microstrip layer, or the distribution of electromagnetic filed underneath the microstrip layer. The electromagnetic filed distributed within the substrate underneath the microstrip layer creates resonance when carrying certain frequencies, or under cavity modes. Among various cavity modes, $TM_{10}$, which is the one carries the lowest resonant frequency, has the largest magnitude of far field strength on the top plane perpendicular to the surface of the microstrip layer, wherein the magnitude of field gradually decays outward. Therefore, the radiation pattern of $TM_{10}$ mode is widely employed in a microstrip antenna. Unlike the resonance of $TM_{10}$ mode, resonance occurring under most of the higher order modes, such as $TM_{30}$ mode, contain fields having null fields due to different directions of current distributions, wherein the null fields degrade the performance of a dual-band microstrip antenna.

In order to overcome the problems caused by the incoherent directions of current distributions of higher order mode, the microstrip layer of the invention is etched into a shape contains dual-notch. The etching process also changes the impedance of the etched microstrip layer in order to achieve a better performance, wherein the impedance matching of the etched microstrip is preferably 50 Ohms. The dual-notch of the microstrip antenna does not only affect the current direction of a $TM_{30}$ mode radiation effectively, they also shift the central frequency and restructure the field distribution of a $TM_{30}$ mode radiation. However, on the other hand, the dual-notch barely changes the characteristics of a $TM_{10}$ mode radiation. Therefore, by properly determining and forming dual-notch of the microstrip layer, a proper impedance matching can be obtained, and the polarization directions and field distributions of a $TM_{10}$ mode radiation and a $TM_{30}$ mode radiation can be made more accordant for achieving a better dual-band performance.

Figure 5:
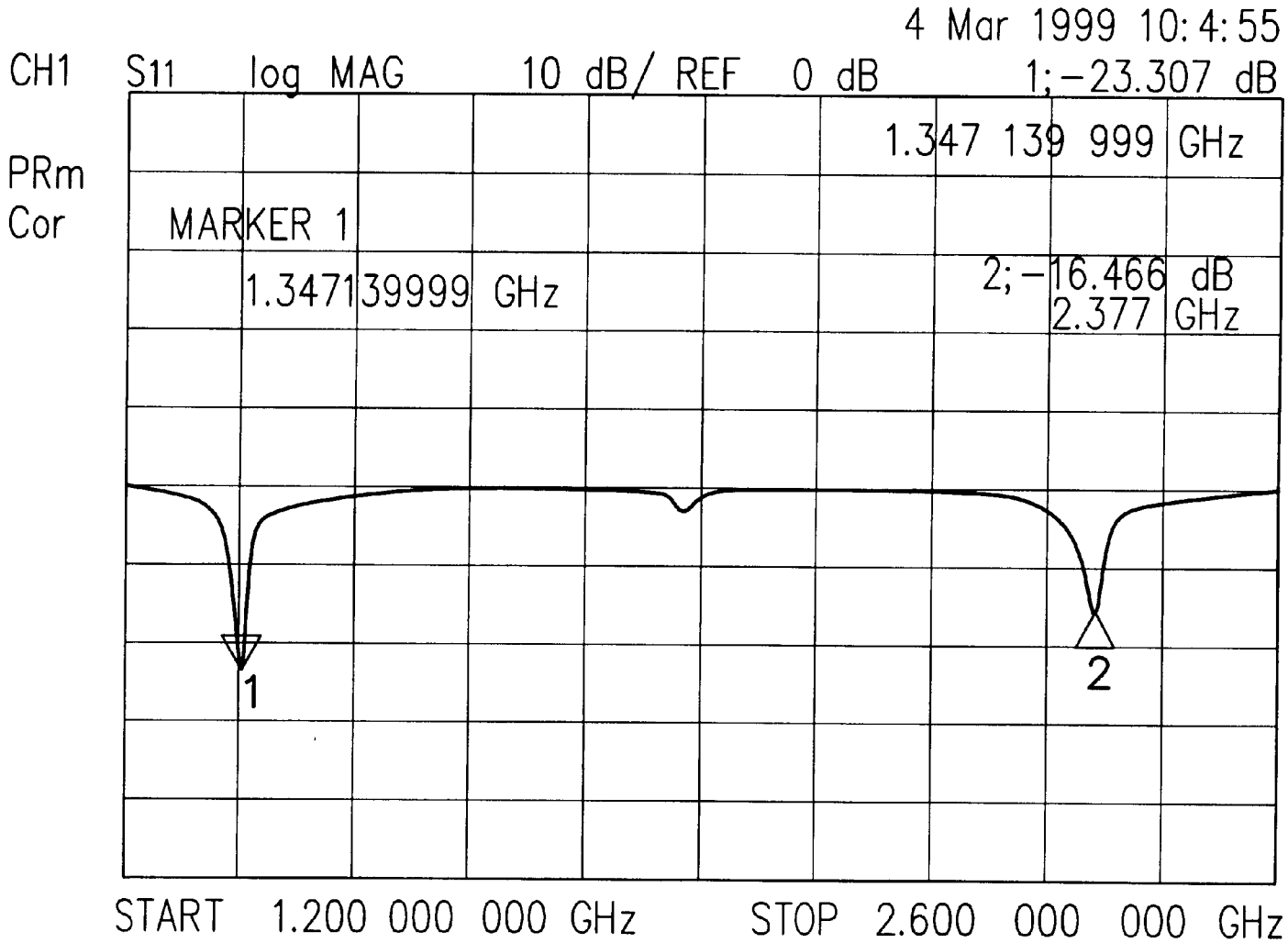
FIG. 5 is a plot showing the experimental reflection coefficient, via signals of various frequencies, of the double dual-notch loaded microstrip antenna of the invention.
Figure 6:
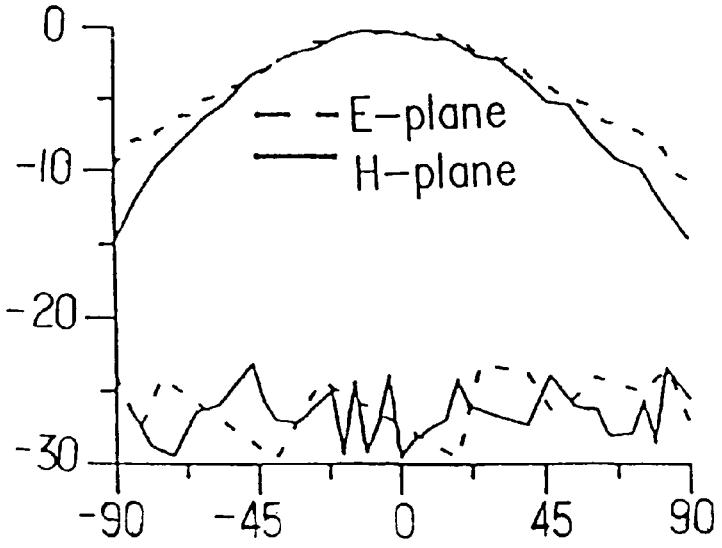
FIG. 6 is a plot showing the radiation patterns and polarization directions of electrical plane and magnetic plane of a signal at frequency of 1.347 GHz.
Figure 7:
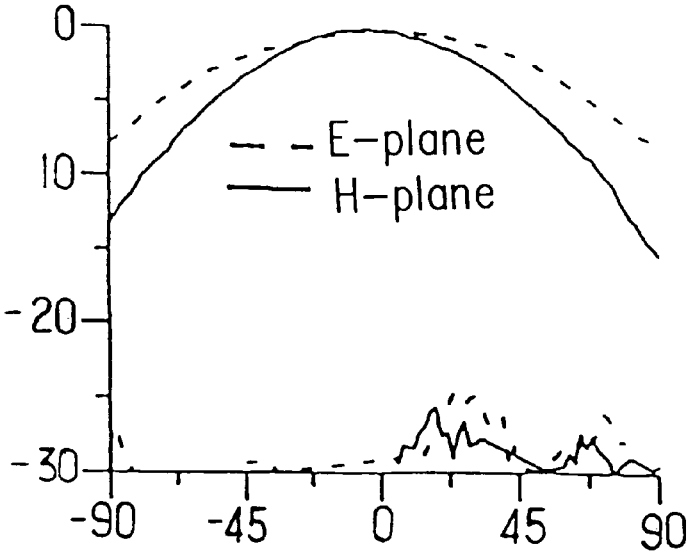
FIG. 7 is a plot showing the radiation patterns and polarization directions of electrical plane and magnetic plane of a signal at frequency of 2.377 GHz.
Figure 8A:
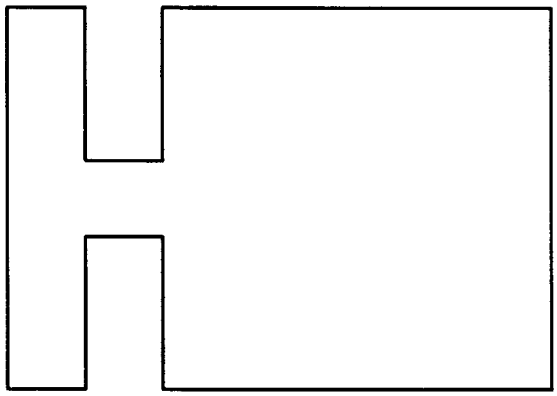
FIGS. 8A to 8K are schematic diagrams showing other derivations of the dual-notch loaded microstrip antenna of the invention.
Figure 8B:
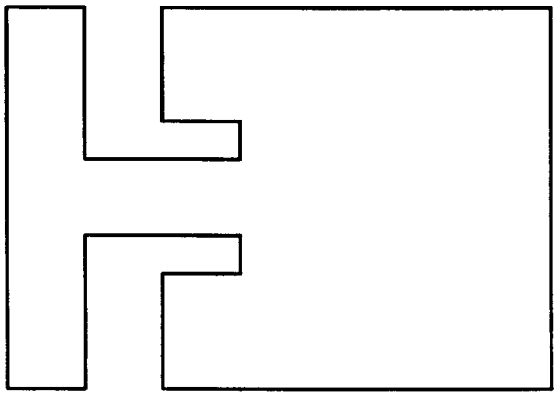
Figure 8C:
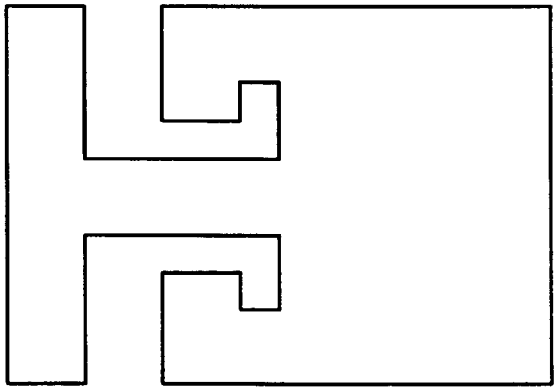
Figure 8D:
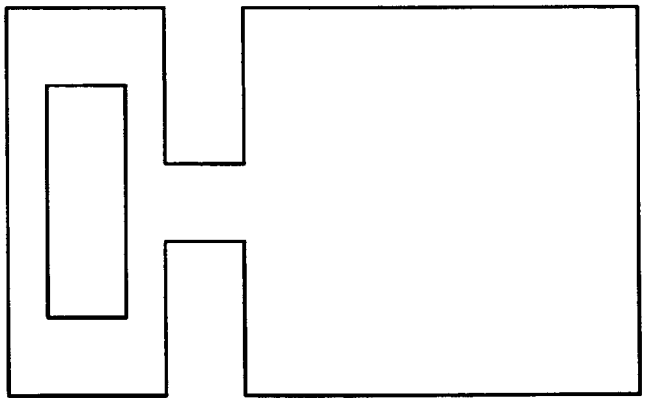
Figure 8E:
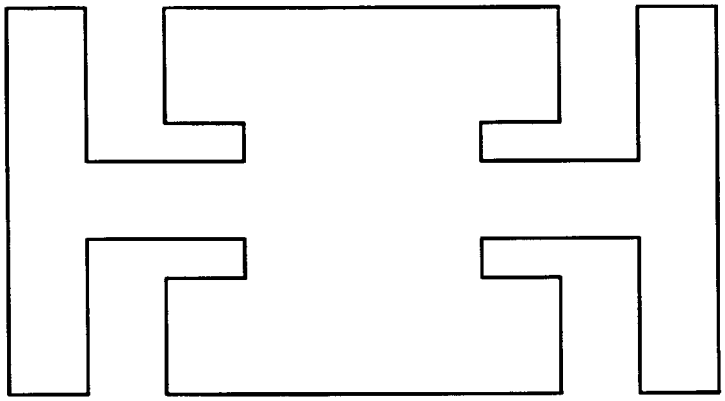
Figure 8F:
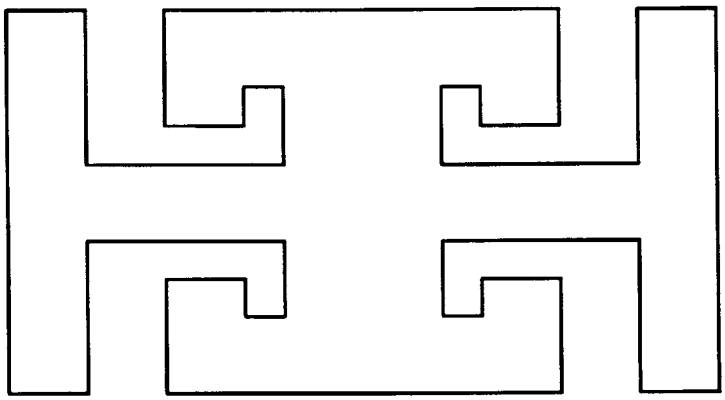
Figure 8G:
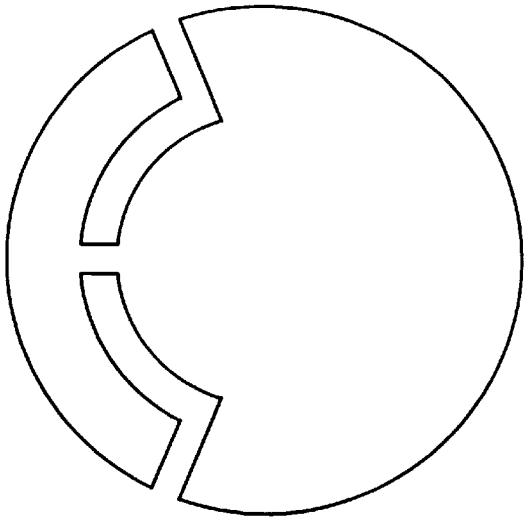
Figure 8H:
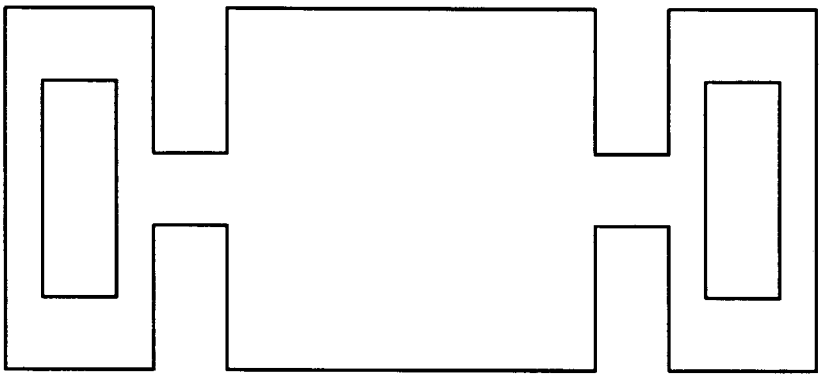
Figure 8I:
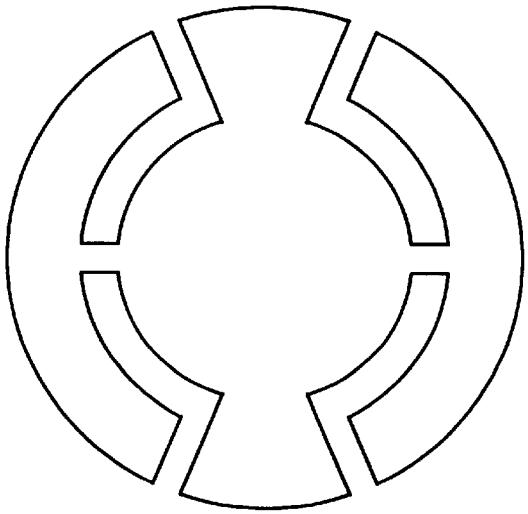
Figure 8J:
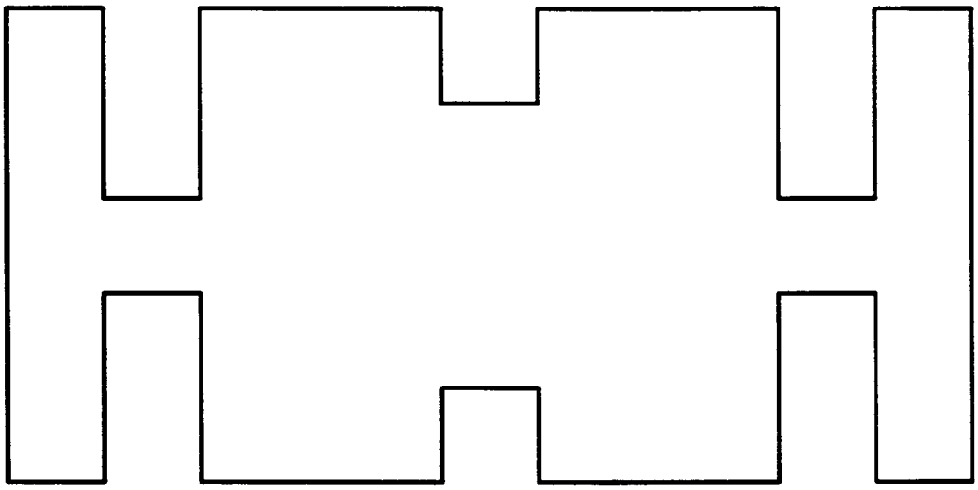
Figure 8K:
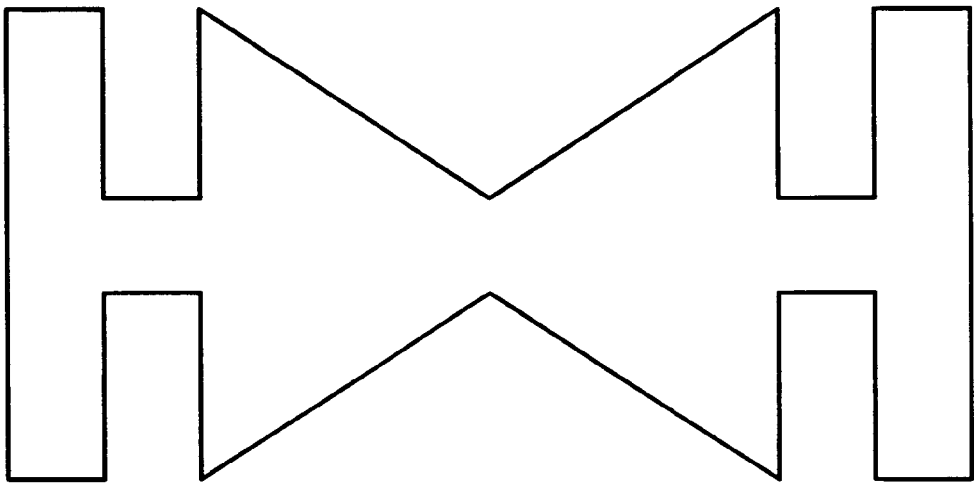

As shown in FIGS. 5 to 7, the results on a simulated model of the invention are illustrated. FIG. 5 is a plot showing the measure reflective coefficient over the microstrip antenna of the invention via corresponding frequencies of signals. It is obvious that the reflection coefficient of signals is apparently low when the signal carries a frequency of either 1.347 GHz or 2.377 GHz. FIG. 6 shows the measured field distributions of the electrical field plane (E-plane) and the magnetic field plane (H-plane) of a signal carrying a frequency of 1.347 GHz, whereas, FIG. 7 shows the measured E-plane and M-plane of the electrical field and the magnetic field of a signal carrying a frequency of 2.377 GHz.

In FIGS. 4A and 4B, the feeding point Xp is located at the center of the y-axis, so that all electrical characteristics of the microstrip antenna according to the invention are symmetric to the y-axis. Under such circumstance, the input impedance matching to the signals of two different frequencies is not linear.

By properly determining the initial conditions and parameters, a preferred value of impedance matching can be found in the Smith Chart. Then, according to the selected impedance matching that is corresponding to the first and the third resonance frequencies respectively, a proper location for placing the feeding point can be determined by applying a general adjusting rule. For a microstrip antenna of the invention that has two dual-notches, the distribution of $TM_{30}$ mode resonating at the third resonance frequency is more disordered than that of $TM_{10}$ mode resonating at the first resonance frequency. A proper impedance matching can also be reached by changing the width W of the notches. Then, by applying the foregoing parameters, proper frequencies of signals can be obtained.

In the preferred embodiment of the invention, all parameters used are determined as following:

the thickness t of the substrate 100 is about 1.6 mm;

the Permittivity $\epsilon_r$ of the substrate 100 is about 4.26;

the tg $\delta$ of the substrate 100 is about 0.012;

the length A and L of the microstrip layer 104 are both about 40 mm;

the width B of the microstrip layer 104 is about 44 mm;

the width W of the T-shaped dual-notch is about 3 mm;

the width d of the neck of the T-shaped dual-notch is about 6 mm;

the width w of the notch is about 1 mm; and the distance Xp between the feeding point 106 and the edge of the notch is about 9 mm. The experimental reflection coefficient in dB obtained according to the above-determined parameters are shown in FIG. 5. It is clear that two frequencies, 1.347 GHz and 2.377 GHz, have the best applicable properties. The characteristics of the signals at those two frequencies, 1.347 GHz and 2.377 GHz, are shown in FIGS. 6 and 7, wherein the orthogonalized magnitudes of cross-polarization of both E-plane and H-plane are less than 20 dB of the co-polarization of the electrical field and magnetic field. It has a ratio of about 1.765 between two dips for the experimental measurements.

Besides the microstrip layer 104 shown in FIG. 4A, other derivative shapes of the microstrip layer of the dual-notch loaded microstrip antenna according to the invention are shown in FIGS. 8A through 8K. In each of the derivations of the invention, the microstrip layer of the microstrip antenna contains at least one dual-notch. That is, any microstrip antenna whose microstrip layer contains a dual-notch portion is within the scope of the invention. In addition, the entity of the microstrip layer can be any shape, such as rectangle, circle, triangle, or combinations of the foregoing. The remains of the notched portion of the microstrip layer contains strips of various shapes, such as a dual-arc shape, a dual-circle shape, dual-hollow shape, a single-arc shape, a single-circle shape, single-hollow shape, or combinations of the foregoing. Furthermore, a dual-band microstrip antenna contains a microstrip layer of any shape that achieves the same goal of the invention. In general, the invention includes providing radiation of different modes with accordant polarization directions and obtaining a proper impedance matching of the antenna by forming at least one notch.

The dual-notch loaded microstrip antenna of the invention carries out the function of a dual-band or a multi-band antenna with a relatively simple structure. Not only simplifying the fabrication process, the microstrip antenna of the invention can also avoid the degradation of performance due to the complicated fabrication process of prior art.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A dual-notch loaded microstrip antenna comprising:

a single-medium substrate;

a metal layer attached to a bottom surface of the single-medium substrate, wherein the metal layer is electrically grounded;

a microstrip layer attached to a top surface of the single-medium substrate, wherein the microstrip layer is shaped to include at least a dual-notch located at end portions, wherein a notch shape of the dual-notch is parallel to a rim shape of the microstrip layer at the end portions; and a penetrating opening through the single-medium substrate for feeding signals to the microstrip antenna from the metal layer.

2. The dual-notch loaded microstrip antenna of claim 1, wherein the signals are fed by using a coaxial feeding connector.

3. The dual-notch loaded microstrip antenna of claim 1, wherein the notches are located on a radiating side of the microstrip layer.

4. The dual-notch loaded microstrip antenna of claim 1, wherein the notches include dual-rectangle shaped strips.

5. The dual-notch loaded microstrip antenna of claim 1, wherein the notches include dual-arc shaped strips.

6. The dual-notch loaded microstrip antenna of claim 1, wherein the notches include dual-circle shaped strips.

7. A notched loaded microstrip antenna comprising:

a single-medium substrate;

a metal layer formed on a bottom surface of the single-medium substrate, wherein the metal layer is electrically grounded;

a microstrip layer formed on a top surface of the single-medium substrate, wherein the microstrip layer is shaped to have two dual-notches symmetrical to each other at end portions of the microstrip layer. wherein a notch shape of the two dual-notch is parallel to a rim shape of the microstrip layer; and a penetrating opening through the single-medium substrate for feeding signals to the microstrip layer from the metal layer.

8. The notched loaded microstrip antenna of claim 7, wherein the signals are fed by using a coaxial feeding connector.

9. The notched loaded microstrip antenna of claim 7, wherein the notch is located on a radiating side of the microstrip layer.

10. The notched loaded microstrip antenna of claim 7, wherein the notch includes a rectangle-shaped strip.

11. The notched loaded microstrip antenna of claim 7, wherein the notch includes an arc-shaped strip.

12. The notched loaded microstrip antenna of claim 7, wherein the notch includes circle-shaped strip.

* * * * *